United States Patent [19]

Brittingham et al.

[11] Patent Number: 4,542,764

[45] Date of Patent: Sep. 24, 1985

[54] LEAK CONTAINMENT KIT

[75] Inventors: Donald Brittingham, New Castle, Del.; George P. Fletcher; Harvey J. Henry, both of Pennsville, N.J.

[73] Assignee: E. I. Du Pont de Nemours and Company, Wilmington, Del.

[21] Appl. No.: 529,623

[22] Filed: Sep. 6, 1983

[51] Int. Cl.[4] ..... B61D 5/00

[52] U.S. Cl. ..... 137/347; 137/592; 105/358

[58] Field of Search ..... 105/358; 137/382, 347, 137/592, 312, 349; 251/144

[56] References Cited

U.S. PATENT DOCUMENTS

| | | | |
|---|---|---|---|
| 1,124,014 | 1/1915 | Greiff et al. | 137/382 |
| 1,156,469 | 10/1915 | Dodge | 137/347 |
| 1,524,762 | 2/1925 | Treaner | 137/382 |
| 1,541,801 | 6/1925 | Durning | 137/382 |
| 1,601,563 | 9/1926 | De Land | 137/382 |
| 1,827,574 | 10/1931 | Frazier | 137/382 |
| 2,092,926 | 9/1937 | Lithgow | 137/347 |
| 2,673,010 | 3/1954 | Barrsu | 137/382 |
| 4,129,146 | 12/1978 | Schuler | 137/592 |

FOREIGN PATENT DOCUMENTS

| | | | |
|---|---|---|---|
| 1030933 | 6/1953 | France | 137/382 |

OTHER PUBLICATIONS

Chlorine Institute Emergency Kit 'C' for Chlorine Tank Cars & Tank Trucks, Edition 6, Jul. 1978.

*Primary Examiner*—A. Michael Chambers

[57] ABSTRACT

A leak containment kit for tank cars is disclosed. The kit is bolted to the manway cover of the tank car and surrounds all of the valves mounted on the manway cover. The kit provides means to connect each of the valves on the manway cover with a valve mounted on the external of the main body of the leak containment kit.

2 Claims, 3 Drawing Figures

LEAK CONTAINMENT KIT

BACKGROUND OF THE INVENTION

1. Field of the Invention

The present invention relates to a leak containment kit for railway tank cars.

2. Prior Art

Present day leak containment kits for railway tank cars carrying liquefied gases utilize a yoke fitted with a screw adapted to urge a gasketed hood over an individual valve and thereby seal off the leaking valve. There are about 55,000 tank cars in the United States used to transport liquefied gases. Somewhat over half of these tank cars have valves which cannot be capped with present day leak containment kits. Furthermore, in the case of a full blow it is virtually impossible to cap a valve with present day leak containment kits.

SUMMARY OF THE INVENTION

The present invention relates to a leak containment kit in which a hood assembly containing an external valve and internal connection means for each of the railway car valves so that the car can be unloaded even though all of the valves are completely covered.

DETAILED DESCRIPTION OF THE DRAWINGS

Figure 1:
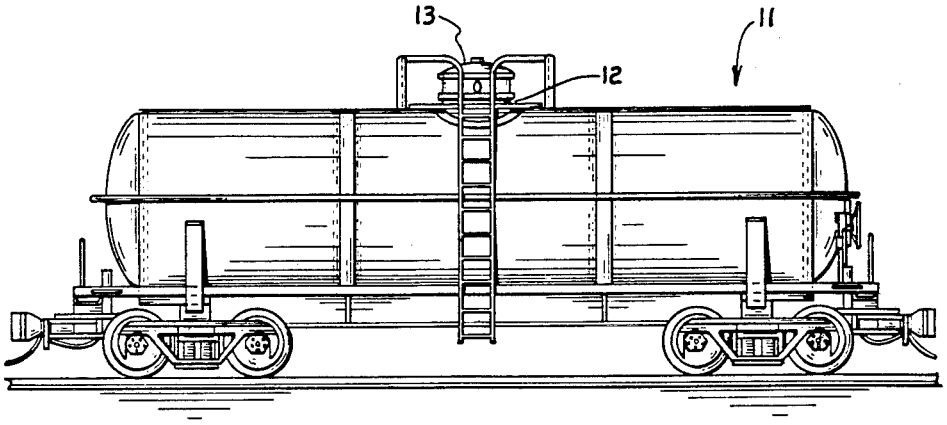
FIG. 1 is a side view of a conventional railway tank car.
Figure 3:
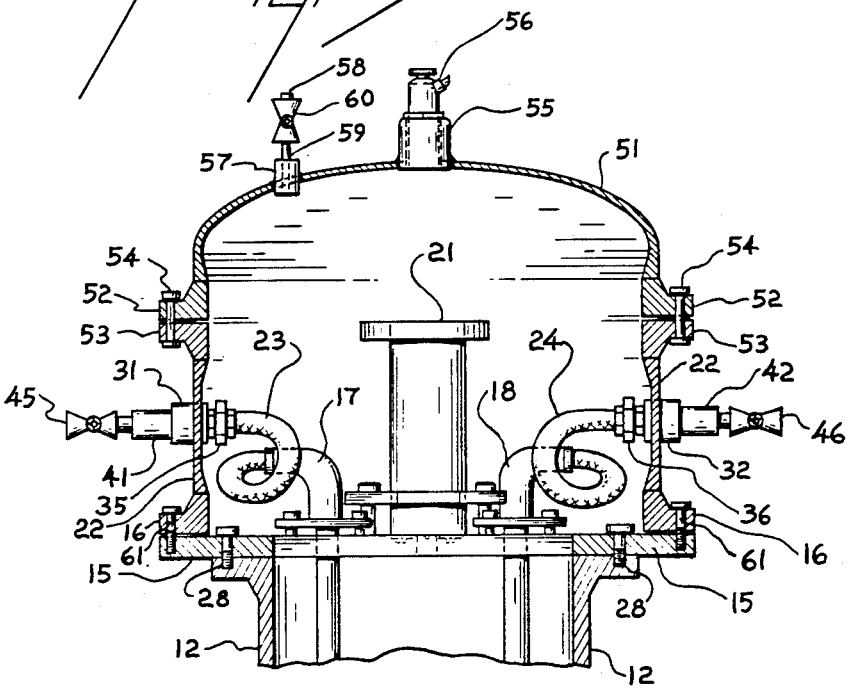
FIG. 3 is a cross-sectional view of the hood sides, connections and valves of the present invention attached to a railway car taken on line 3—3 of FIG. 2 and including the hood cover.
Figure 2:
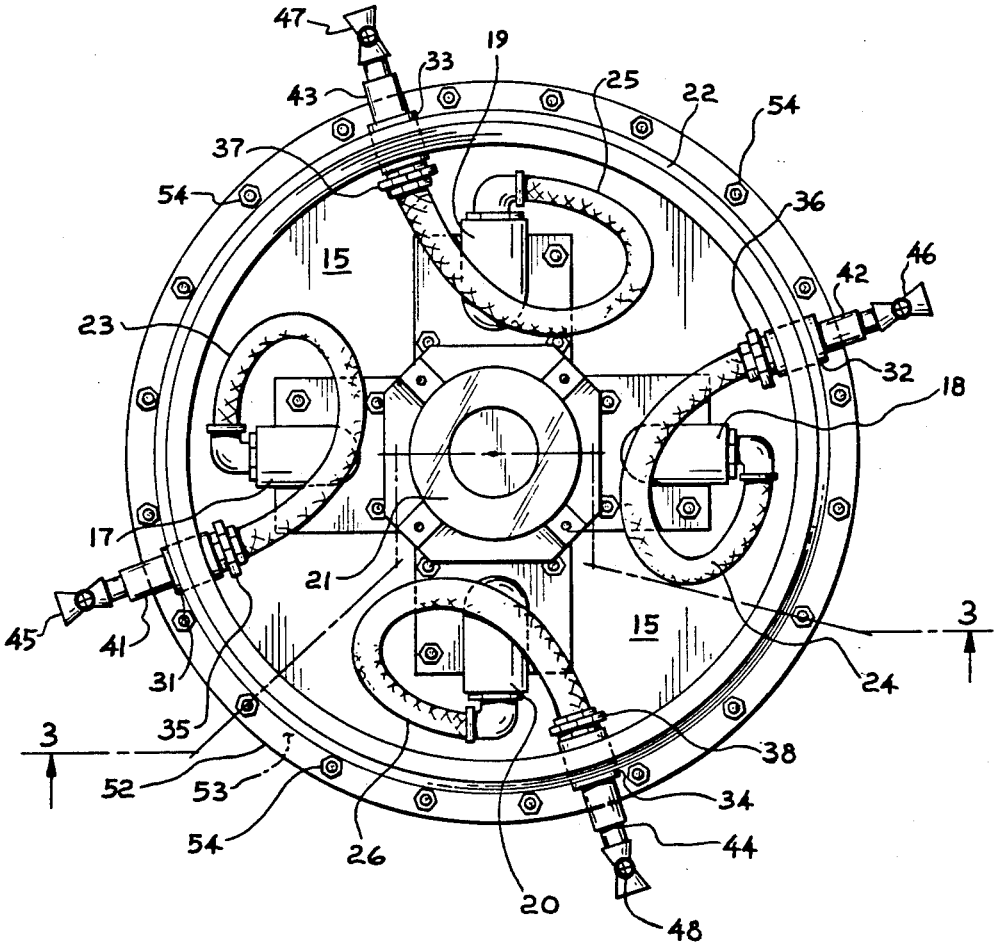
FIG. 2 is a top view of the hood sides, connections and valves of the present invention.

Referring now to FIG. 1, a railway tank car is depicted generally at 11. Tank car 11 is fitted with a manway 12, and protective housing 13. Referring now to FIG. 2, loading and unloading valves 17, 18, 19 and 20 as well as relief valve 21 are shown mounted on manway cover 15 which is fastened to manway 12 by means of studs 28 (FIG. 3). The foregoing is a typical manway and valve arrangement of a tank car. When applying the leak containment kit of the present invention, protective housing 13 is removed from manway cover 15 and replaced with cylindrical main body 22 of the leak containment kit of which flange 16 is bolted to manway cover 15 by studs 61 (FIG. 3). Flexible hoses 23, 24, 25 and 26 are then attached to valves 17, 18, 19 and 20. Flexible hoses 23, 24, 25 and 26 are than attached to internally threaded connectors 31, 32, 33 and 34 by means of connectors 35, 36, 37 and 38. External connectors 41, 42, 43 and 44 serve to connect valves 45, 46, 47 and 48 to threaded connectors 31, 32, 33 and 34. At this point, referring now to FIG. 3, cover 51 is bolted through flange 52 to flange 53 of main body 22 by means of bolts 54. Cover 51 contains threaded coupling 55 to receive a safety valve 56, and threaded coupling 57 to receive threaded connector 59, and valve 60 which has a plug 58 screwed therein. There should be a gasket between both the pairs of bolted flanges.

In some tank cars the valves are set so close to the protective housing 13 that when main body 22 is in position there is insufficient room to install hoses 23, 24, 25 and 26. In this case main body 22 is provided with aperatures directly opposite the opendings of valves 17, 18, 19, and 20, and pipes are connected to valves 17, 18, 19 and 20 which pipes go through the aperatures in main body 22 which aperatures are sealed with blind flanges and the pipes connected to tubing to receive the contents of the tank cars by means of compression fittings.

For use in capping cars carrying liquefied hydrogen fluoride, which requires a service pressure capability of 100 psi ($6.9\times10^5$ Pa), the containment lid and main body walls should be made of $\frac{1}{4}''$ (0.006 m) thick steel walls. High pressures require more heavily constructed kits. More corrosive gases require the use of stainless steel or titanium as the material of construction. Because of its venting capability during installation, the leak containment kit of the present invention can be used to cap full flow leaks.

We claim:

1. A leak containment kit for a railway tank car comprising an open ended cylindrical main body having on its bottom end an external flange adapted to be attached and sealed to a manway cover on the tank car, a plurality of threaded connectors in the wall of said main body, each adapted externally of the cylindrical main body to connect to a valve and internally to connect to a hollow member which is connected to a tank car loading/unloading valve mounted on said manway cover, a cover having on its open end an external flange adapted to be attached and sealed to a flange on the top of the cylindrical main body.

2. The leak containment kit of claim 1 wheren the hollow member which is connected to the tank car loading/unloading valve is flexible.

* * * * *